US006179171B1

(12) United States Patent
Ferguson et al.

(10) Patent No.: US 6,179,171 B1
(45) Date of Patent: Jan. 30, 2001

(54) SAND DISTRIBUTION APPARATUS FOR USE IN FOUNDRY OPERATION

(75) Inventors: Gregory L. Ferguson, Cottondale; David S. Sheldon, Homewood, both of AL (US)

(73) Assignee: Vulcan Engineering Company, Helena, AL (US)

( * ) Notice: Under 35 U.S.C. 154(b), the term of this patent shall be extended for 0 days.

(21) Appl. No.: 09/326,369

(22) Filed: Jun. 4, 1999

(51) Int. Cl.[7] ..... B22C 15/10
(52) U.S. Cl. ..... 222/502; 164/192
(58) Field of Search ..... 222/502, 503, 222/142.1; 164/192, 194

(56) References Cited

U.S. PATENT DOCUMENTS

| | | | | |
|---|---|---|---|---|
| 518,559 | * | 4/1894 | Berry | 222/142.1 |
| 734,165 | * | 7/1903 | Drewery | 222/142.1 |
| 3,933,100 | * | 1/1976 | Dugge | 105/282.3 |
| 4,181,171 | | 1/1980 | Yonemitsu . | |
| 4,593,739 | | 6/1986 | VanRens et al. | 164/34 |
| 4,641,768 | * | 2/1987 | Hill | 222/590 |
| 4,685,504 | | 8/1987 | Bond et al. | 164/203 |
| 4,744,404 | | 5/1988 | Sakoda et al. . | |
| 4,766,771 | | 8/1988 | Bailey et al. . | |
| 4,768,567 | | 9/1988 | Travillian . | |
| 4,776,493 | | 10/1988 | Tegel | 222/196 |
| 4,971,135 | | 11/1990 | Bailey et al. | 164/192 |
| 5,176,189 | * | 1/1993 | Perchanthaler et al. | 141/98 |

* cited by examiner

*Primary Examiner*—J. Casimer Jacyna
(74) *Attorney, Agent, or Firm*—Robert J. Veal; Christopher A. Holland; Burr & Forman LLP

(57) ABSTRACT

An apparatus for promoting uniform sand distribution into a mold flask in a foundry process, comprising a fixed distribution plate mounted subjacent a hopper and a slide distribution plate slidably mounted subjacent the fixed plate, wherein the slide plate has a repeating series of apertures therethrough with each aperture series corresponding to one aperture through the fixed plate. Each aperture series comprises a plurality of apertures having different diameters wherein the largest aperture diameter is substantially equal to the uniform aperture diameter through the fixed plate. Accordingly, the slide plate is movable between a plurality of open positions such that as different flow rates are desired through the distribution plates, the appropriate sized apertures through the slide plate are fully aligned with the apertures through the fixed plate. In an alternate embodiment, the sand distribution apparatus comprises a fixed distribution plate mounted subjacent a hopper, a first slide distribution plate slidably mounted subjacent the fixed plate, and a second slide distribution plate slidably mounted subjacent the first slide plate, such that the apertures through the distribution plates can be aligned to form a plurality of zigzag channels through which sand can flow at a reduced flow rate from the hopper into the mold flask. The present invention substantially reduces or eliminates skewed sand flow and substantially eliminates offset sand flow encountered in the prior art sand distribution apparatus having only a single slide plate when the apertures through the fixed and slide plates are partially overlapped for reduced sand flow.

12 Claims, 8 Drawing Sheets

SAND DISTRIBUTION APPARATUS FOR USE IN FOUNDRY OPERATION

FIELD OF THE INVENTION

The present invention relates to an apparatus for use in a foundry operation. More particularly, the present invention relates to an apparatus for controlling the distribution of sand into a mold flask in a casting process, such as a lost foam casting process.

BACKGROUND OF THE INVENTION

In a typical lost foam casting process, a foam mold pattern is placed within a mold flask, wherein the mold pattern includes a foam riser that extends from the pattern towards the top of the flask. Sand from a hopper located above the flask is poured into the flask about the pattern. As the sand fills the flask, the sand becomes compacted about the pattern, forming a mold cavity. After the flask has been adequately filled with sand, which preferably corresponds to a level equal to the top of the riser, molten metal is poured through the riser into the mold cavity, which vaporizes the foam riser and pattern. Thus, the molten metal replaces the foam pattern. The metal is cooled until the casting is solidified, at which time the casting and sand are removed from the flask.

A problem that has been encountered in the industry is that if sand is not uniformly distributed about the foam pattern during the sand filling process, the pattern is subjected to uneven weight distribution from the sand which can damage or distort the pattern, resulting in an inferior or unusable casting. Various improvements to address this problem have been implemented with varying degrees of success. One such improvement is the use of sand distribution plates to promote uniform distribution of sand in the flask, wherein a first distribution plate ("fixed plate") having a plurality of apertures therethrough is affixed to the bottom of the hopper and a second distribution plate ("slide plate") having a plurality of apertures therethrough, corresponding to the apertures through the first plate, is slidably mounted subjacent the first plate such that the second plate is movable between a closed position, wherein the apertures in the first and second plates do not overlap, and an open position, wherein the apertures in the first and second plates overlap such that multiple streams of sand "rain" into the flask. The apertures through the plates can be fully overlapped for maximum sand flow, or they can be partially overlapped to infinitely variable degrees for reduced sand flow. This is an important feature because when sand is initially poured into the flask, the flow rate should be reduced so that the sand (1) will not damage the pattern and (2) will have adequate time to fill any cavities in the pattern. As the sand level rises above the top of the pattern, the apertures through the distribution plates are preferably fully overlapped for maximum sand flow to quickly fill the remainder of the flask, thereby maximizing production efficiency.

While use of the sand distribution plates, collectively known in the art as a "rain gate" or "sand gate", has substantially improved uniform sand distribution in the flask, other problems have arisen. First, when the apertures in the distribution plates are partially overlapped, the sand flow therethrough is (1) skewed such that the sand tends to accumulate towards one side of the flask rather than uniformly therein and (2) offset from the center of the apertures through the fixed plate, thereby shifting the predetermined streams of sand such that the sand tends to accumulate towards one side of the flask rather than uniformly therein.

The non-uniform sand accumulation results in uneven weight distribution about the pattern which can damage or distort the pattern, resulting in an inferior or unusable casting. Second, sand can accumulate between the plates and between the slide plate and the supports therefor. If this occurs, as the sand gate is opened and closed, abrasion from the sand will slowly erode the plate surfaces until gaps form between the plates, resulting in (1) greater sand accumulation between the plates and between the slide plate and the supports therefor, thereby increasing the erosion, (2) increased skewed and offset sand flow during the reduced sand flow portion of the filling cycle, and (3) greater sand flow than predicted at any particular overlapped position during the reduced sand flow portion of the filling cycle.

Accordingly, what is needed is an improved sand gate design to promote uniform sand distribution in a mold flask which overcomes the problems in the prior art.

SUMMARY OF THE PRESENT INVENTION

It is an object of the present invention to provide an apparatus for controlling the distribution of sand into a mold flask in a casting process.

It is another object of the present invention to provide a sand distribution apparatus for controlling the distribution of sand into a mold flask at different rates of sand flow.

It is another object of the present invention to provide a sand distribution apparatus having one fixed distribution plate and at least one slide distribution plate.

It is another object of the present invention to provide a sand distribution apparatus which produces substantially vertical streams of sand at any designated flow rate to promote uniform sand distribution within the mold flask.

It is another object of the present invention to provide a sand distribution apparatus which substantially reduces or eliminates skewing of flowing sand during reduced flow rates to promote uniform sand distribution within the mold flask.

It is another object of the present invention to provide a sand distribution apparatus which substantially eliminates offset of flowing sand from the center of the apertures through the fixed plate during reduced flow rates to promote uniform sand distribution within the mold flask.

It is another object of the present invention to provide a sand distribution apparatus which reduces accumulation of sand between the distribution plates and between the slide plate(s) and the supports therefor to reduce erosion of the plate surfaces.

These and other objects of the present invention are accomplished through the use of a sand distribution apparatus for promoting uniform sand distribution into a mold flask in a casting process, such as a lost foam casting process. The sand distribution apparatus comprises (1) a fixed plate mounted subjacent a hopper, wherein the fixed plate has a plurality of uniform apertures therethrough through which sand flows from the hopper into the mold flask, and (2) a slide plate slidably mounted subjacent the fixed plate, wherein the slide plate has a repeating series of apertures therethrough with each aperture series corresponding to one aperture through the fixed plate such that the slide plate is movable between a closed position, wherein the apertures through the fixed and slide plates do not overlap, and a plurality of open positions, wherein the apertures through the fixed and slide plates overlap. Each aperture series through the slide plate comprises a plurality of apertures having different diameters wherein the largest aperture diameter is substantially equal to the aperture diameter through the fixed plate. Accordingly, as different flow rates are desired through the distribution plates, the appropriate sized apertures through the slide plate are fully aligned with the apertures through the fixed plate. This allows for varying rates of sand flow without having to partially overlap the apertures through the fixed and slide plates, thereby eliminating skewed and offset sand flow. The slide plate is preferably supported on a series of rollers which maintain the plates in abutment with one another to resist sand from penetrating between the plates. If sand does penetrate between the plates, any sand which migrates to the edges of the plates will fall to the floor or into the flask rather than accumulate between the slide plate and the supports therefor.

In an alternate embodiment, the sand distribution apparatus comprises (1) a fixed plate mounted subjacent a hopper, wherein the fixed plate has a plurality of uniform apertures therethrough through which sand flows from the hopper into the mold flask, (2) a first slide plate slidably mounted subjacent the fixed plate, wherein the first slide plate has a plurality of uniform apertures therethrough corresponding to the apertures through the fixed plate such that the first slide plate is movable between a closed position, wherein the apertures through the fixed and first slide plates do not overlap, and an open position, wherein the apertures through the fixed and first slide plates overlap, and (3) a second slide plate slidably mounted subjacent the first slide plate, wherein the second slide plate has a plurality of uniform apertures therethrough corresponding to the apertures through the fixed and first slide plates such that the second slide plate is movable between a closed position, wherein the apertures through the second slide plate do not overlap the apertures through the fixed and first slide plates, and an open position, wherein the apertures through the second slide plate overlap the apertures through the fixed and first slide plates. During the sand filling cycle of the foundry process, the first slide plate is preferably urged in a first longitudinal direction such that the apertures through the fixed and first slide plates partially overlap and the second slide plate is preferably urged in an opposite longitudinal direction such that the apertures through the second slide plate partially overlap the apertures through the fixed and first slide plates, wherein this orientation of the apertures through the distribution plates forms a plurality of zigzag channels through which sand can flow from the hopper into the mold flask. The use of the second slide plate substantially reduces skewed sand flow and eliminates offset sand flow encountered in the prior art apparatus having only a single slide plate when the apertures through the fixed and slide plates are partially overlapped. As the sand level rises above the top of the pattern, the apertures through the distribution plates are preferably fully overlapped for maximum sand flow to quickly fill the remainder of the flask.

These and other objects and advantages of the invention will become apparent from the following detailed description of the preferred embodiment of the invention.

BRIEF DESCRIPTION OF THE DRAWINGS

A sand distribution apparatus embodying features of the invention is described in the accompanying drawings which form a portion of this disclosure and wherein.

DETAILED DESCRIPTION OF THE PREFERRED EMBODIMENT

A more complete understanding of the invention may be obtained by reference to the accompanying drawings wherein the relevant portions of a prior art foundry operation and some of the problems encountered therein are illustrated in FIGS. 1–4, and the illustrative embodiments of the present invention are illustrated in FIGS. 5–14B. Further, while the description herein is particularly directed to a lost foam casting process, the present invention has application in any foundry operation in which sand is distributed into a mold flask.

Figure 1:
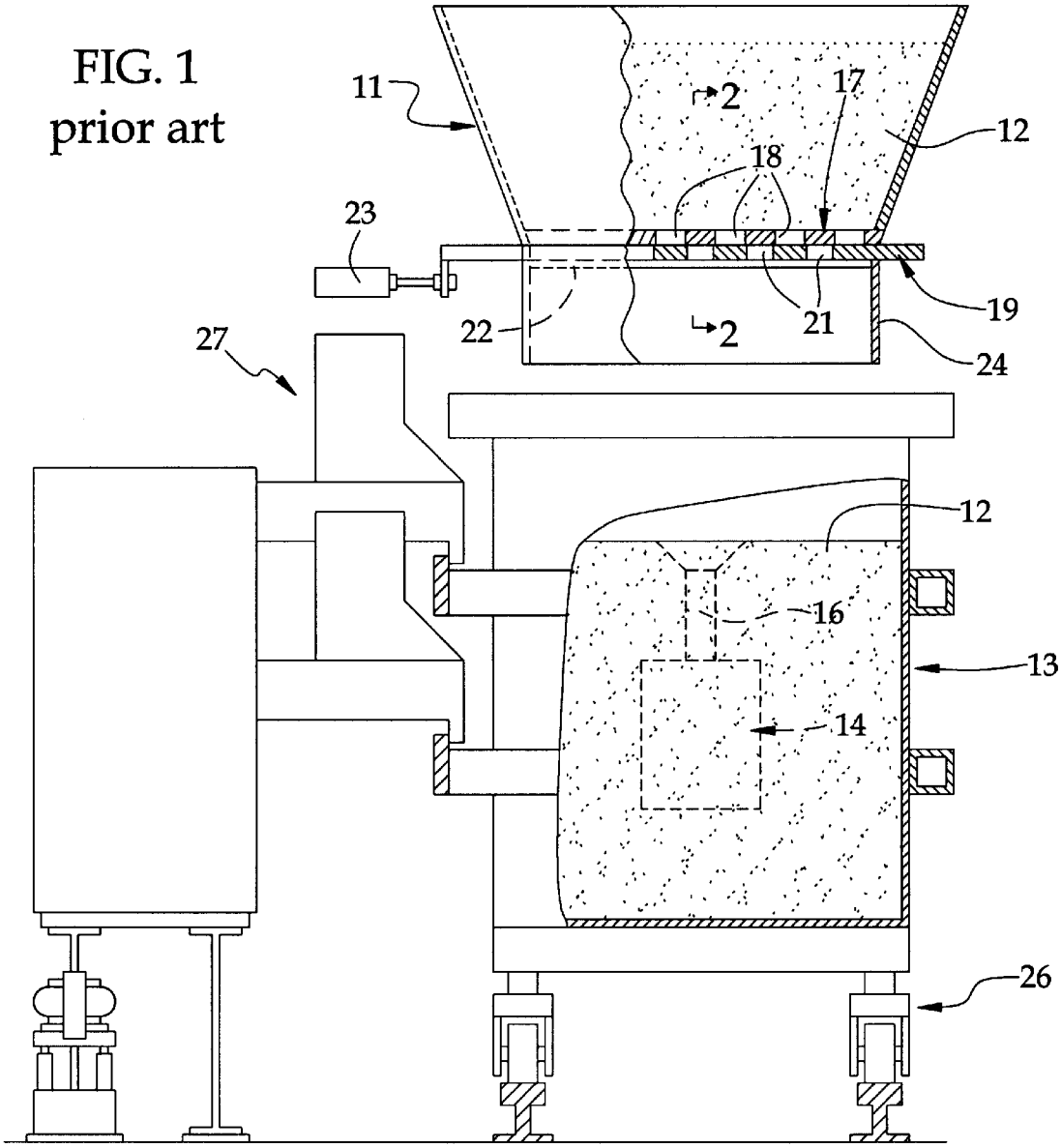
FIG. 1 prior art
FIG. 1 is a side elevational view, partially broken away and in section, of a typical sand filling station in a prior art foundry operation.

FIG. 1 illustrates a sand filling station in a typical foundry operation, wherein a hopper 11 having a supply of sand 12 therein is suspended over a mold flask 13 having a foam mold pattern 14 therein. The pattern 14 includes a foam riser 16 extending from the pattern 14 towards the top of the flask 13. A first distribution plate 17 having a plurality of apertures 18 therethrough is affixed to the bottom of the hopper 11 and a second distribution plate 19 having a plurality of apertures 21 therethrough, corresponding to the number and placement of the apertures 18 through the first plate 17, is slidably mounted subjacent the first plate 17 such that the second plate 19 is movable between a closed position, wherein the apertures 18, 21 through the first and second plates 17, 19 do not overlap, and an open position, wherein the apertures 18, 21 through the first and second plates 17, 19 overlap such that multiple streams of sand can flow through the distribution plates 17, 19 into the flask 13. The second plate 19, or "slide plate", is supported by a pair of opposing elongated L-brackets 22 mounted to the first plate 17 through which the slide plate 19 is longitudinally driven by driving means 23, such as hydraulic cylinders. A guide jacket 24 is preferably suspended below the distribution plates 17, 19 to direct sand from the periphery of the distribution plates 17, 19 into the flask 13. The flask 13 is supported on conveying means 26 which carry the flask 13 into and out of the filling station. The filling station preferably includes a vibrating apparatus 27 which vibrates the flask 13 during the sand filling process to promote proper distribution and compaction of the sand about the pattern 14 and into any cavities or crevices therein. The equipment and methods used for vibrating mold flasks are well known in the foundry art (see e.g. U.S. Pat. Nos. 4,600,046 and 4,593,739 to Bailey and VanRens) and will not be set forth herein.

Figure 2:
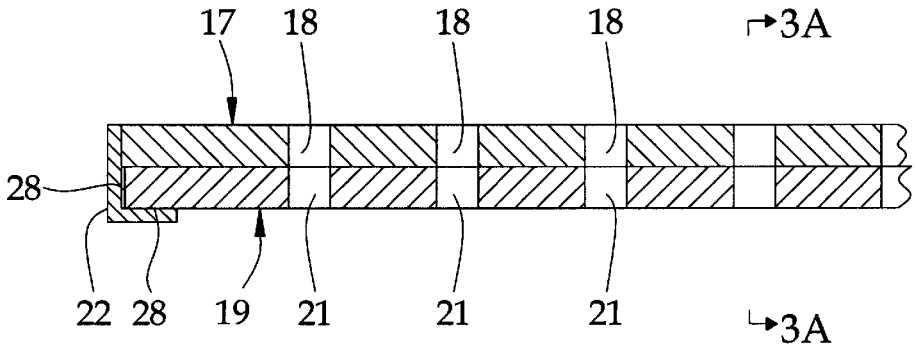
FIG. 2 prior art
FIG. 2 is a sectional view of the sand distribution plates taken along line 2—2 of FIG. 1 with the sand gate in a partially open position.
Figure 3A:
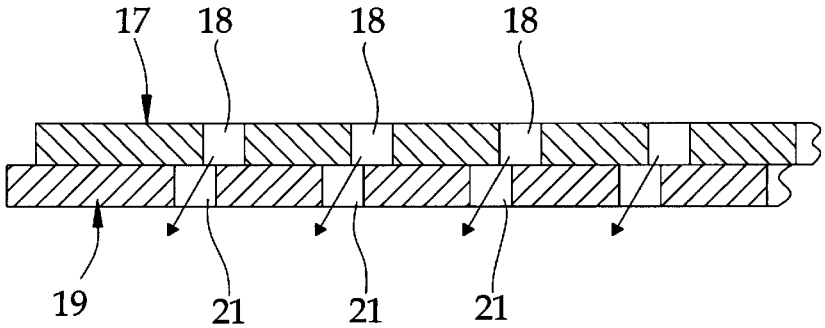
FIG. 3A prior art
FIG. 3A is a sectional view of the sand distribution plates taken along line 3—3 of FIG. 2.
Figure 3B:
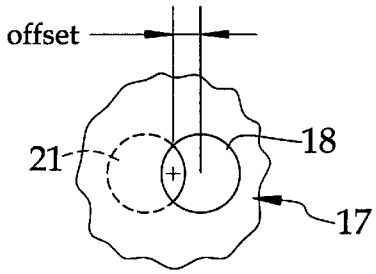
FIG. 3B prior art
FIG. 3B is a top plan view of overlapping apertures of the sand distribution plates of FIG. 3A.
Figure 4:
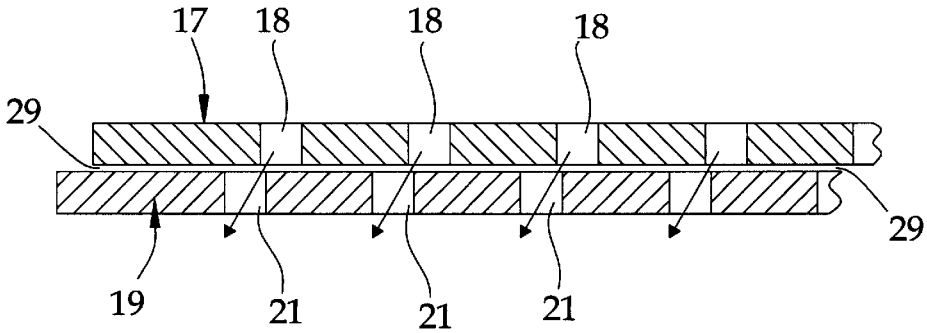
FIG. 4 prior art
FIG. 4 is a sectional view, equivalent to the view of FIG. 3, of sand distribution plates having a gap formed therebetween.
Figure 5:
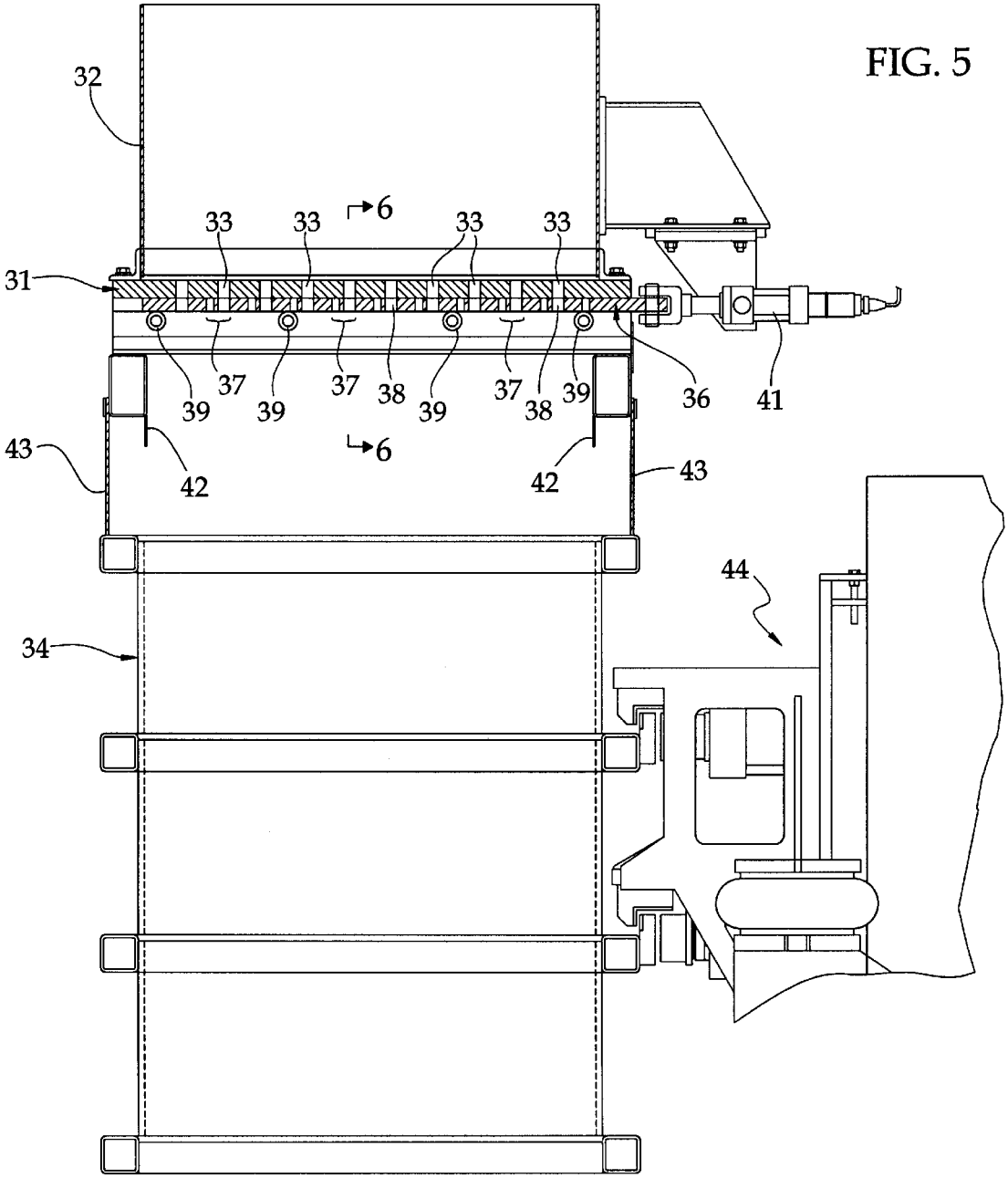
FIG. 5 is a side elevational view, partially in section, of a sand filling station in a foundry operation illustrating features of the present invention.
Figure 6:
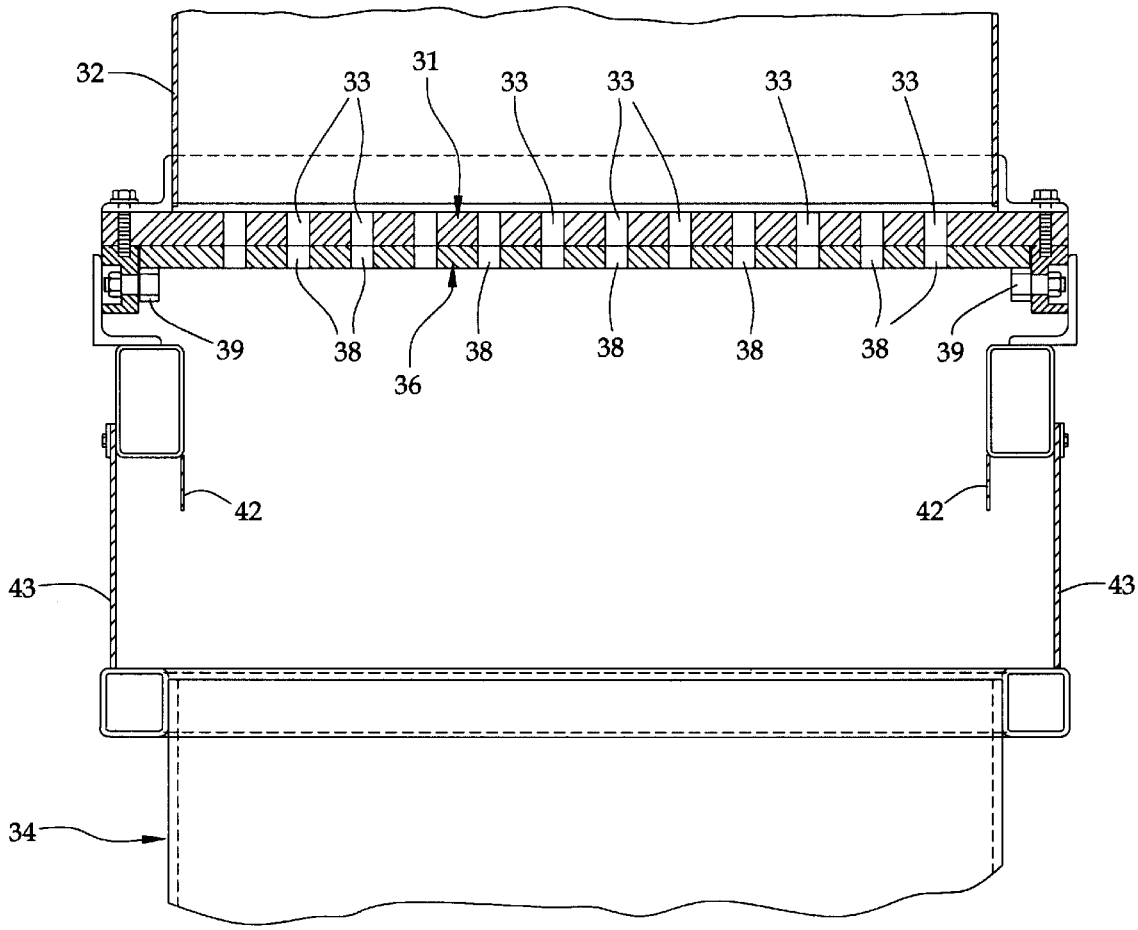
FIG. 6 is sectional view taken along line 6—6 of FIG. 5.
Figure 7:
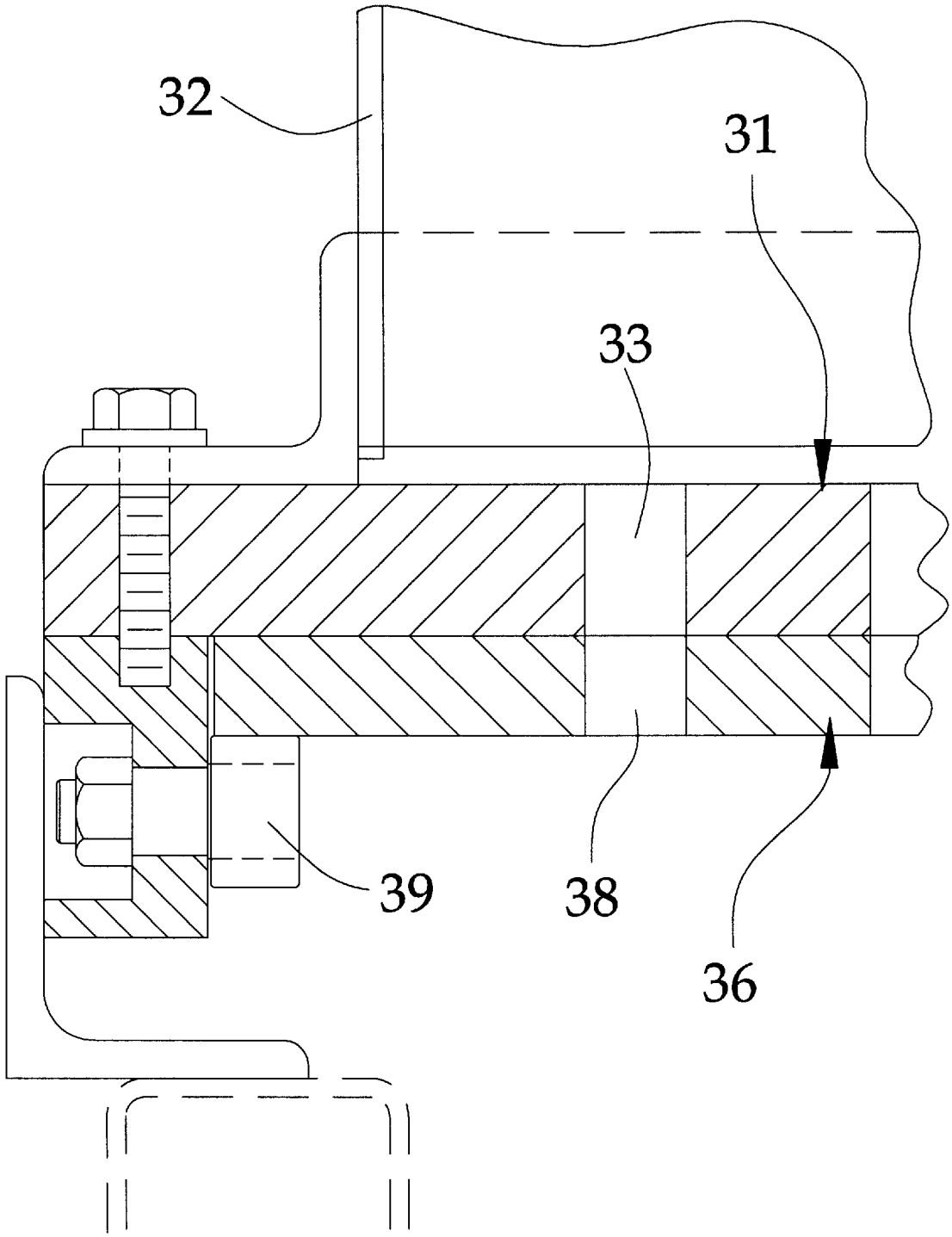
FIG. 7 is an enlarged sectional view of the supporting means for the distribution plates.
Figure 9A:
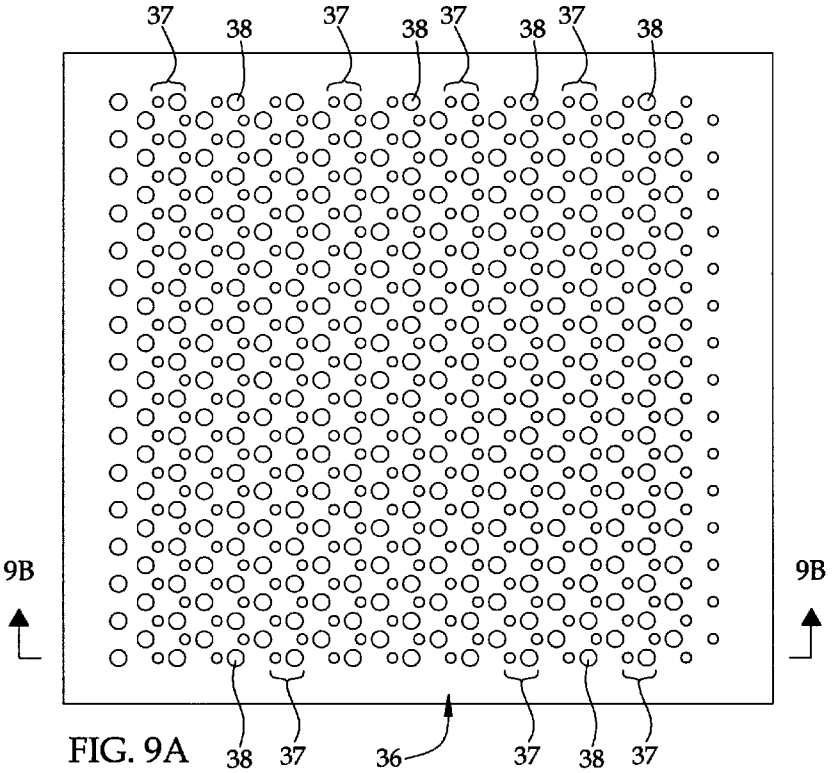
FIG. 9A is a plan view of a slide plate of the present invention.
Figure 9B:
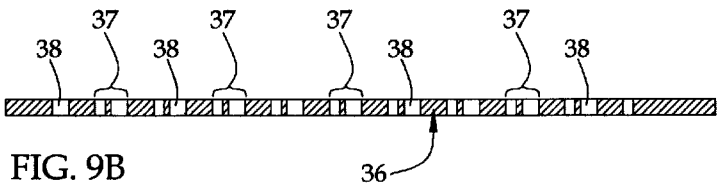
FIG. 9B is a sectional view taken along line 9B—9B of FIG. 9A.
Figure 8A:
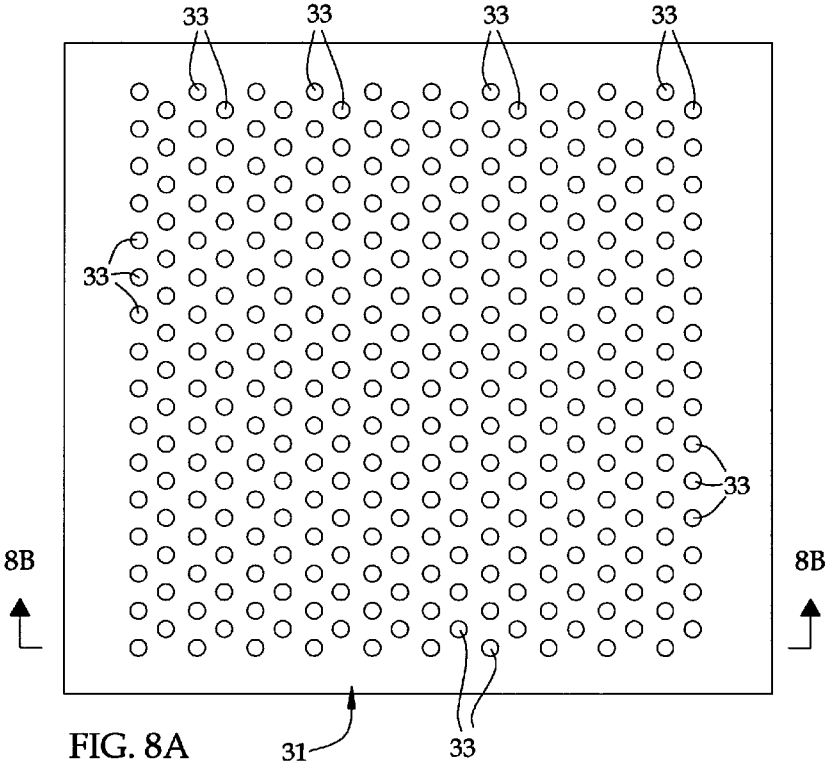
FIG. 8A is a plan view of a fixed plate.
Figure 8B:
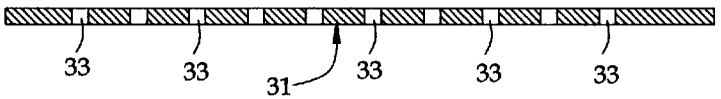
FIG. 8B is a sectional view taken along line 8B—8B of FIG. 8A.

FIGS. 2–4 illustrate prior art sand distribution plates 17, 19 with the sand gate in a partially open position for reduced sand flow. FIG. 3A illustrates the skewed sand flow encountered with prior art distribution plates 17, 19 in a partially open position, which results in accumulation of sand towards one side of the flask 13 rather than uniformly therein. FIG. 3B illustrates the offset of sand flow from the center of the apertures through the fixed plate encountered with prior art distribution plates 17, 19 in a partially open position, which shifts the predetermined streams of sand such that the sand tends to accumulate towards one side of the flask 13 rather than uniformly therein. FIG. 4 illustrates gaps 29 between the distribution plates 17, 19, which can result from sand erosion or improper alignment of the plates 17, 19. Sand erosion occurs when sand penetrates the space between the plates 17, 19 and migrates to the edges of the plates 17, 19 and accumulates between the slide plate 19 and the L-bracket 22, wherein the areas of sand accumulation are designated at positions 28 in FIG. 2. As the sand gate is opened and closed, abrasion from the sand will slowly erode the abutting surfaces of the distribution plates 17, 19 and the abutting surfaces of the slide plate 19 and the L-bracket 22 until gaps 29 form between the plates 17, 19, resulting in (1) greater sand accumulation between the plates 17, 19 and between the slide plate 19 and the L-bracket 22, thereby increasing the erosion, (2) increased skewed and offset sand flow during the reduced sand flow portion of the filling cycle, and (3) greater sand flow than predicted at any particular overlapped position during the reduced sand flow portion of the filling cycle. Although illustrated as uniform and contiguous in FIG. 4, the gaps 29 typically develop from non-uniform erosion.

To overcome the shortcomings in the prior art, the inventors of the present invention have invented a novel sand distribution apparatus, wherein a preferred embodiment shown in FIGS. 5–12B comprises a first distribution plate 31, or "fixed plate", mounted subjacent a hopper 32, wherein the fixed plate 31 has a plurality of uniform apertures 33 therethrough, through which sand flows from the hopper 32 into a mold flask 34, and (2) a second distribution plate 36, or "slide plate", slidably mounted subjacent the fixed plate 31, wherein the slide plate 36 has a repeating series of apertures therethrough with each aperture series 37 corresponding to one aperture 33 through the fixed plate 31 such that the slide plate 36 is movable between a closed position, wherein the apertures through the fixed and slide plates 31, 36 do not overlap, and a plurality of open positions, wherein the apertures through the fixed and slide plates 31, 36 overlap. Each aperture series 37 through the slide plate 36 comprises a plurality of apertures having different diameters wherein the largest aperture 38 diameter corresponds to the aperture 33 diameter through the fixed plate 31. Accordingly, as different flow rates are desired through the distribution plates 31, 36, the appropriate sized apertures through the slide plate 36 are fully aligned with the apertures 33 through the fixed plate 31. This allows for varying rates of sand flow without having to partially overlap the apertures through the distribution plates 31, 36, thereby eliminating skewed and offset sand flow. The slide plate 36 is preferably supported on a series of rollers 39 which maintain the distribution plates 31, 36 in abutment with one another to resist sand from penetrating therebetween. If sand does penetrate between the distribution plates 31, 36, any sand which migrates to the edges of the distribution plates will fall to the floor or into the flask 34 rather than accumulate between the slide plate 36 and the support therefor, as seen with the prior art L-bracket (see FIG. 2). Further, the rollers 39 allow the slide plate 36 to be moved between positions quicker than that available from the prior art L-bracket (see FIG. 2), and are preferably vertically adjustable to maintain the distribution plates 31, 36 in abutment with one another.

Figure 10:
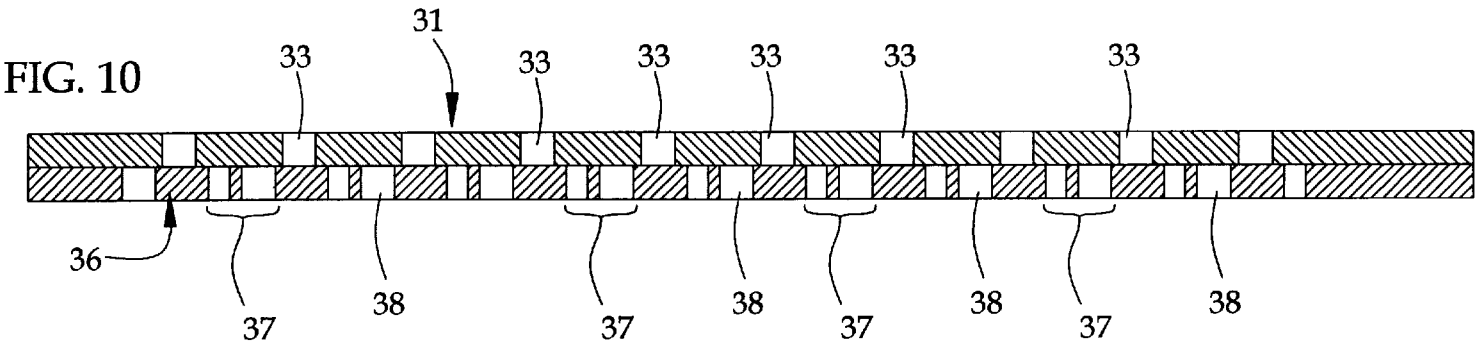
FIG. 10 is a sectional view of the distribution plates of the present invention in a closed position.
Figure 11A:
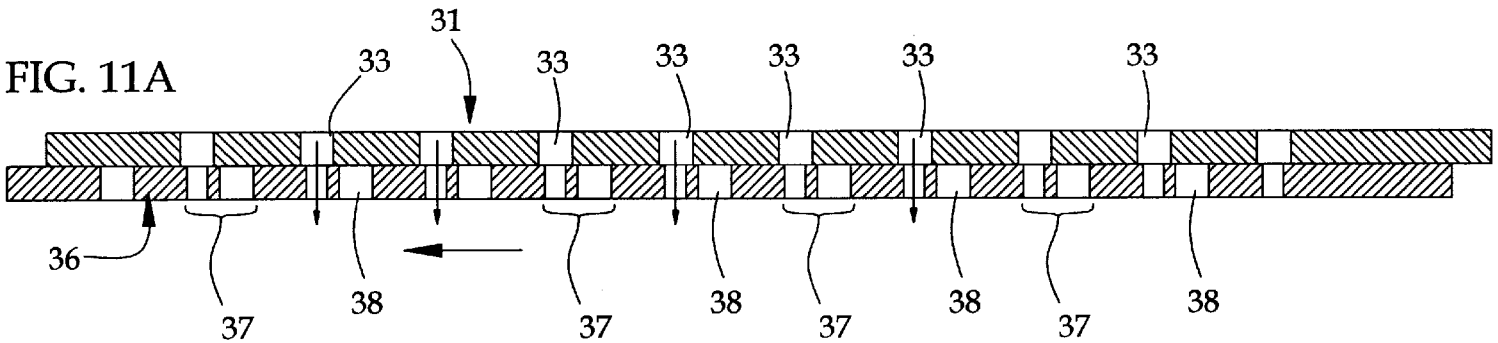
FIG. 11A is a sectional view of the distribution plates of FIG. 10 in a first opened position.
Figure 11B:
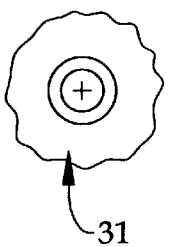
FIG. 11B is a top plan view of overlapping apertures of the sand distribution plates of FIG. 11A.
Figure 12A:
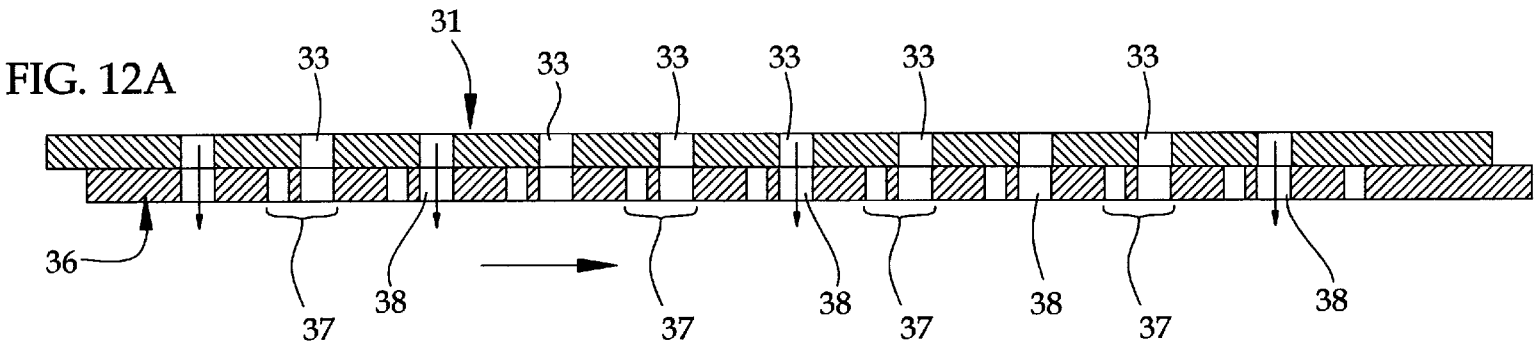
FIG. 12A is a sectional view of the distribution plates of FIG. 10 in a second opened position.
Figure 12B:
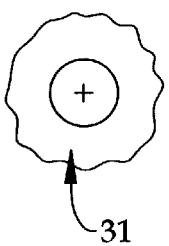
FIG. 12B is a top plan view of overlapping apertures of the sand distribution plates of FIG. 12A.

The filling station includes urging means 41, such as hydraulic cylinders, for urging the slide plate 36 longitudinally between the closed position, illustrated in FIG. 10, and the various open positions, illustrated in FIGS. 11A–12B. While the figures herein illustrate an aperture series 37 having only two apertures, it should be understood that the slide plate can include any realistic number of apertures having different diameters in a series, and that the aperture series could alternatively be placed through the fixed plate instead. The filling station also preferably includes guide means 42 for guiding sand from the periphery of the distribution plates 31, 36 into the flask 34, a dust shield 43 to prevent sand fines from escaping into the surrounding environment, and vibrating means 44 to vibrate the flask 34 during the sand filling process to promote proper distribution and compaction of the sand about the mold pattern and into any cavities or crevices therein.

Figure 13:
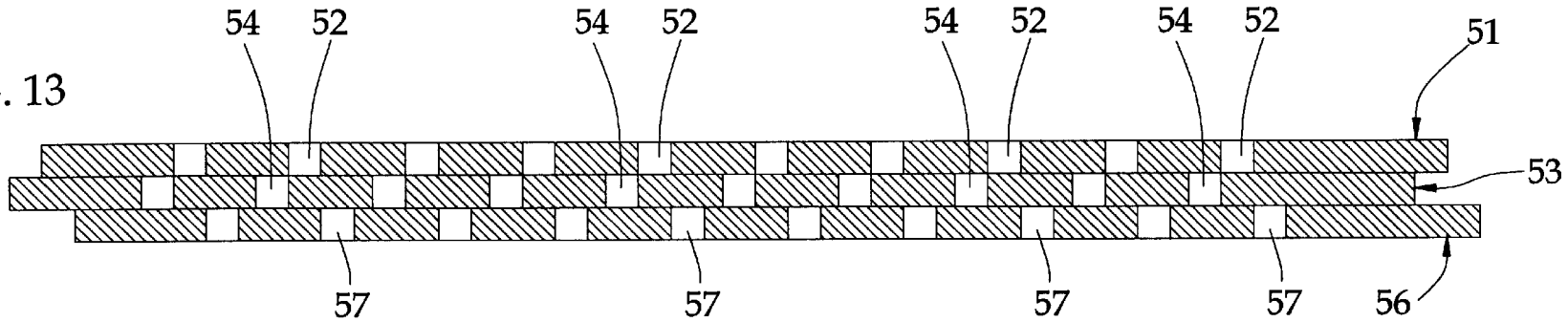
FIG. 13 is a sectional view of distribution plates in a closed position in an alternate embodiment of the present invention.
Figure 14A:
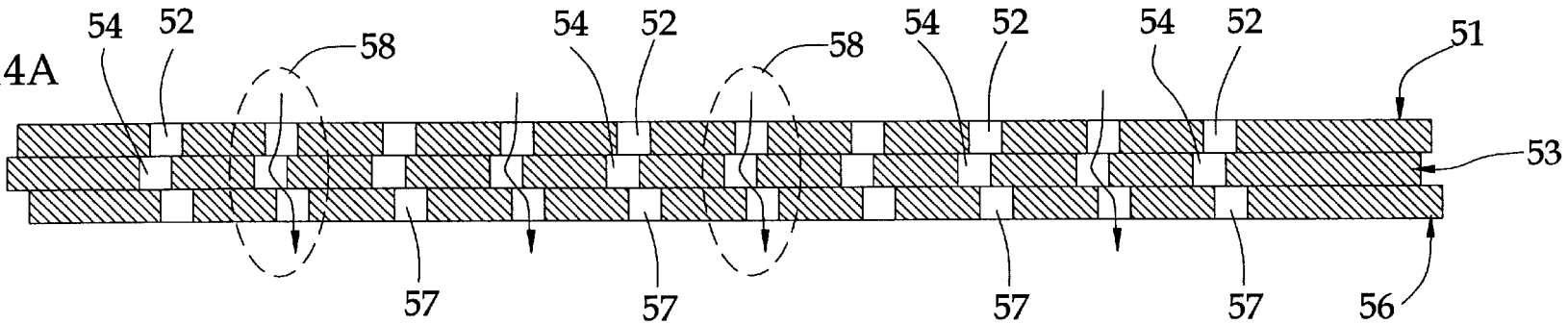
FIG. 14A is a sectional view of the distribution plates of FIG. 13 in a partially opened position.
Figure 14B:
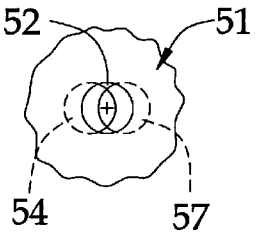
FIG. 14B is a top plan view of overlapping apertures of the sand distribution plates of FIG. 14A.

In an alternate embodiment shown in FIGS. 13–14B, the sand distribution apparatus comprises (1) a fixed distribution plate 51, mounted subjacent a hopper (not shown), wherein the fixed plate 51 has a plurality of uniform apertures 52 therethrough through which sand flows from the hopper into a mold flask (not shown), (2) a first slide distribution plate 53 slidably mounted subjacent the fixed plate 51, wherein the first slide plate 53 has a plurality of uniform apertures 54 therethrough corresponding in number and placement to the apertures 52 through the fixed plate 51 such that the first slide plate 53 is movable between a closed position, wherein the apertures 52, 54 through the fixed and first slide plates 51, 53 do not overlap, and an open position, wherein the apertures 52, 54 through the fixed and first slide plates 51, 53 overlap, and (3) a second slide distribution plate 56 slidably mounted subjacent the first slide plate 53, wherein the second slide plate 56 has a plurality of uniform apertures 57 therethrough corresponding to the number and placement of the apertures 52, 54 through the fixed and first slide plates 51, 53 such that the second slide plate 56 is movable between a closed position, wherein the apertures 57 through the second slide plate 56 do not overlap the apertures 52, 54 through the fixed and first slide plates 51, 53, and an open position, wherein the apertures 57 through the second slide plate 56 overlap the apertures 52, 54 through the fixed and first slide plates 51, 53. During the sand filling cycle of the foundry process, the first slide plate 51 is urged in a first longitudinal direction such that the apertures 52, 54 through the fixed and first slide plates 51, 53 partially overlap and the second slide plate 56 is urged in an opposite longitudinal direction such that the apertures 57 through the second slide plate 56 partially overlap the apertures 52, 54 through the fixed and first slide plates 51, 53, wherein this orientation of the apertures 52, 54, 57 through the distribution plates 51, 53, 56 forms a plurality of zigzag channels 58, shown in FIGS. 14A and 14B, through which sand can flow from the hopper into the mold flask. The use of the second slide plate 56 substantially reduces skewed sand flow and eliminates offset sand flow encountered in the prior art apparatus having only a single slide plate when the apertures through the fixed and slide plates are partially overlapped (see FIGS. 3A and 3B). As the sand level rises above the top of the pattern, the apertures 52, 54, 57 through the distribution plates 51, 53, 56 are preferably fully overlapped for maximum sand flow to quickly fill the remainder of the flask.

It is to be understood that the form of the invention shown is a preferred embodiment thereof and that various changes and modifications may be made therein without departing from the spirit of the invention or scope as defined in the following claims.

Having set forth the nature of the invention, what is claimed is:

1. An apparatus for distributing sand from a hopper into a mold flask in a foundry process, comprising:

a first plate affixed to a lower portion of the hopper, wherein said first plate has a plurality of uniform apertures therethrough;

a second plate slidably mounted subjacent said first plate and in abutment therewith, wherein said second plate has a repeating series of apertures therethrough with each of said aperture series corresponding to one of said uniform apertures through said first plate such that said second plate is movable between a closed position, wherein said apertures through said first and second plates do not overlap, and a plurality of open positions, wherein said apertures through said first and second plates overlap such that sand flows from the hopper, through the overlapping apertures through said first and second plates, and into the mold flask;

wherein each of said aperture series through said second plate comprises a plurality of apertures having different diameters such that said plurality of open positions corresponds to different flow rates of sand;

means operatively connected to said second plate for urging said second plate between said closed position and said plurality of open positions; and means for supporting said second plate, wherein said supporting means maintains said first and second plates in abutment.

2. An apparatus according to claim 1, wherein the largest aperture diameter in said aperture series is substantially equal to the diameter of said uniform apertures through said first plate.

3. An apparatus according to claim 1, wherein said supporting means comprises at least two rollers mounted subjacent each of two opposing sides of said second plate.

4. An apparatus according to claim 3, wherein said rollers are vertically adjustable.

5. An apparatus for distributing sand from a hopper into a mold flask in a foundry process, comprising:

a first plate affixed to a lower portion of the hopper, wherein said first plate has a plurality of apertures therethrough;

a second plate slidably mounted subjacent said first plate and in abutment therewith, wherein said second plate has a plurality of apertures therethrough with each of said apertures corresponding to one of said apertures through said first plate such that said second plate is movable between a closed position, wherein said apertures through said first and second plates do not overlap, and infinitely variable open positions, wherein said apertures through said first and second plates overlap such that sand flows from the hopper, through the overlapping apertures through said first and second plates, and into the mold flask;

means operatively connected to said second plate for urging said second plate between said closed and open positions; and means for supporting said second plate, wherein said supporting means comprises at least two rollers mounted subjacent each of two opposing sides of said second plate.

6. An apparatus according to claim 5, wherein said rollers are vertically adjustable.

7. An apparatus for distributing sand from a hopper into a mold flask in a foundry process, comprising:

a first plate affixed to a lower portion of the hopper, wherein said first plate has a plurality of uniform apertures therethrough;

a second plate slidably mounted subjacent said first plate and in abutment therewith, wherein said second plate has a plurality of uniform apertures therethrough with each of said apertures corresponding to one of said apertures through said first plate;

a third plate slidably mounted subjacent said second plate and in abutment therewith, wherein said third plate has a plurality of uniform apertures therethrough with each of said apertures corresponding to one of said apertures through said first and second plates;

wherein said second and third plates are movable between a closed position, wherein the apertures through said first, second, and third plates do not overlap, and infinitely variable open positions, wherein the apertures through said first, second, and third plates overlap such that sand flows from the hopper, through the overlapping apertures through said first, second, and third plates, and into the mold flask;

means operatively connected to said second and third plates for urging said second and third plates between said closed and open positions; and means for supporting said third plate, wherein said supporting means maintains said first, second, and third plates in abutment.

8. An apparatus according to claim 7, wherein said supporting means comprises at least two rollers mounted subjacent each of two opposing sides of said third plate.

9. An apparatus according to claim 8, wherein said rollers are vertically adjustable.

10. An apparatus according to claim 7, further comprising means for supporting said second plate, wherein said means for supporting said second plate maintains said first and second plates in abutment.

11. An apparatus according to claim 10, wherein said means for supporting said second plate comprises at least two rollers mounted subjacent each of two opposing sides of said second plate.

12. An apparatus according to claim 11, wherein said rollers are vertically adjustable.

* * * * *